US006530242B2

(12) United States Patent
Pompl

(10) Patent No.: US 6,530,242 B2
(45) Date of Patent: Mar. 11, 2003

(54) OBTAINING ARGON USING A THREE-COLUMN SYSTEM FOR THE FRACTIONATION OF AIR AND A CRUDE ARGON COLUMN

(75) Inventor: Gerhard Pompl, Beilngries (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 10/102,013

(22) Filed: Mar. 21, 2002

(65) Prior Publication Data

US 2002/0178747 A1 Dec. 5, 2002

(30) Foreign Application Priority Data

Mar. 21, 2001 (DE) ..... 101 13 791

(51) Int. Cl.[7] ..... F25J 3/00
(52) U.S. Cl. ..... 62/643; 62/924
(58) Field of Search ..... 62/643, 646, 924, 62/900

(56) References Cited

U.S. PATENT DOCUMENTS

| | | | | |
|---|---|---|---|---|
| 4,433,989 A | | 2/1984 | Erickson | |
| 4,854,954 A | | 8/1989 | Erickson | |
| 5,689,975 A | * | 11/1997 | Oakey et al. | 62/653 |
| 5,819,556 A | * | 10/1998 | Higginbotham et al. | 62/653 |
| 5,852,940 A | * | 12/1998 | Higginbotham et al. | 62/653 |
| 6,196,024 B1 | * | 3/2001 | Ha | 62/654 |
| 6,202,441 B1 | * | 3/2001 | Ha | 62/646 |
| 6,276,170 B1 | * | 8/2001 | Ha | 62/646 |

FOREIGN PATENT DOCUMENTS

| | | |
|---|---|---|
| EP | 0770841 | 5/1997 |
| EP | 1094286 | 4/2001 |

* cited by examiner

*Primary Examiner*—William C. Doerrler
(74) *Attorney, Agent, or Firm*—Millen, White, Zelano & Branigan, P.C.

(57) ABSTRACT

The process and the apparatus are used to obtain argon using a three-column system for the fractionation of air, which has a high-pressure column (11), a low-pressure column (13) and a medium-pressure column (12). A first charge air stream (10, 64) is introduced into the high-pressure column (11), where it is separated into a first oxygen-enriched liquid and a first nitrogen top gas. A first oxygen-enriched fraction (23, 24, 26) from the high-pressure column (11) is introduced into the medium-pressure column (12), where it is separated into a second oxygen-enriched liquid and a second nitrogen top gas. A second oxygen-enriched fraction (33, 35), from the high-pressure column and/or from the medium-pressure column (12) is introduced into the low-pressure column (13), where it is separated into a third oxygen-enriched liquid and a third nitrogen top gas. An argon-containing fraction (68) from the low-pressure column (13) is introduced into a crude argon column (70), where it is separated into a crude argon top fraction and an oxygen-rich liquid. At least a part (73) of the crude argon top fraction (71) is passed into a crude argon condenser (29), where it is at least partially condensed by indirect heat exchange with at least a part (27) of the second oxygen-enriched liquid from the medium-pressure column (12). Oxygen-enriched vapor (32) which is formed in the process is returned to the medium-pressure column (12). A fraction (72) from the upper region of the crude argon column (70) and/or a part of the crude argon top fraction downstream of the crude argon condenser is obtained as crude argon product.

15 Claims, 7 Drawing Sheets

OBTAINING ARGON USING A THREE-COLUMN SYSTEM FOR THE FRACTIONATION OF AIR AND A CRUDE ARGON COLUMN

CROSS REFERENCE TO RELATED APPLICATION

This application is related to Applicants' concurrently filed application entitled, "Three-Column System For The Low-Temperature Fractionation Of Air" based on German Application No. 10113790.7, filed Mar. 21, 2001.

The invention relates to a process for obtaining argon using a three-column system for the fractionation of air and a crude argon column. In the process, the air is distilled in a three-column system, which has a high-pressure column, a low-pressure column and a medium-pressure column. The medium-pressure column is used to separate a first oxygen-enriched fraction from the high-pressure column, in particular in order to generate nitrogen, which is used in liquefied form as reflux in the low-pressure column or is extracted as product. An argon-containing fraction for the three-column system, in particular from the low-pressure column, is introduced into a crude argon column in which oxygen and argon are separated from one another.

The fundamentals of the low-temperature fractionation of air in general are described by the monograph "Tieftemperaturtechnik" [cryogenics] by Hausen/Linde ($2^{nd}$ edition, 1985) and in an article by Latimer in Chemical Engineering Progress (Vol. 63, No. 2, 1967, page 35). In the three-column system, the high-pressure column and low-pressure column preferably form a Linde double column, i.e. these two columns are connected so as to exchange heat via a main condenser. (However, in principle the invention can also be applied to other arrangements of high-pressure column and low-pressure column and/or other condenser configurations.) Unlike the conventional Linde two-column process, in the three-column process not all the oxygen-enriched liquid which is formed in the high-pressure column is introduced directly into the low-pressure column, but rather a first oxygen-enriched fraction from the high-pressure column flows into the medium-pressure column, where it is broken down further, specifically under a pressure which is between the operating pressures of high-pressure column and low-pressure column. In this case, nitrogen ("second nitrogen top gas") is generated in the medium-pressure column from the first oxygen-enriched fraction, and this nitrogen is liquefied and used as additional reflux in the three-column system and/or is obtained as liquid product. Three-column processes of this type are known, for example, from DE 1065867 B, DE 2903089 A, U.S. Pat. No. 5,692,395 or EP 1043556 A.

Three-column systems with an additional crude argon column are known, for example, from the above-mentioned article by Latimer, from U.S. Pat. No. 4,433,989, EP 147460 A, EP 828123 A or EP 831284 A.

In addition to the four columns mentioned for nitrogen/oxygen separation and for oxygen/argon separation, further separating devices may be provided, for example a pure argon column for argon/nitrogen separation or one or more columns for obtaining krypton and/or xenon, and also non-distillative separation or further cleaning devices.

The invention is based on the object of providing a process and an apparatus for obtaining argon using a three-column system and a crude argon column, which process and apparatus are particularly economically advantageous.

This object is achieved by the fact that the production of liquid reflux for the crude argon column and the production of rising vapour for the medium-pressure column are carried out in a single heat exchange operation. In other words, the crude argon condenser is simultaneously operated as the bottom evaporator of the medium-pressure column. Therefore, a single condenser/evaporator is sufficient for both functions. Within the context of the invention, firstly the outlay on apparatus is particularly low, and secondly the process according to the invention is particularly favourable in terms of energy, for example as a result of the reduction in exchange losses.

Looking back, at first glance one could infer that something similar has already been shown in WO 8911626, which shows a double column with crude argon column, the crude argon condenser having a mass transfer section amounting to a few theoretical plates. However, this mass transfer section is operated at the same pressure as the low-pressure column, and therefore even this reason means that it is no longer a medium-pressure column in the sense of the invention.

It is preferable for at least a part of the second nitrogen top gas from the medium-pressure column to be at least partially and preferably completely condensed by indirect heat exchange with a cooling fluid. Liquid nitrogen which is generated in the process can be returned to the medium-pressure column as liquid reflux; in this case, this indirect heat exchange fulfils the function of a top condenser of the medium-pressure column. However, condensate which is obtained from the second nitrogen top gas can also be extracted as liquid product and/or used as reflux in the low-pressure column. In principle, any of the known fractions, for example oxygen-enriched liquid from the high-pressure column, from the medium-pressure column or from the low-pressure column, can be used as cooling fluid for the condensation of the second nitrogen top gas from the medium-pressure column.

It is expedient if, in the process according to the invention, the crude argon condenser is designed as a falling-film evaporator. In this case, the second oxygen-enriched liquid from the medium-pressure column is only partially evaporated in the crude argon condenser. The resulting two-phase mixture is introduced into a phase-separation device, in which the oxygen-enriched vapour and a proportion which has remained in liquid form are separated from one another. The oxygen-enriched vapour is returned to the medium-pressure column. The proportion which has remained in liquid form is introduced into the low-pressure column. Designing the crude argon condenser as a falling-film evaporator results in a particularly low temperature difference between liquid fraction space and evaporation space. This property contributes to optimizing the pressures at which crude argon column and medium-pressure column are operated.

However, it is particularly favourable if a second charge air stream is liquefied and then used as cooling fluid for the condensation of the second nitrogen top gas from the medium-pressure column. Between liquefaction and introduction into the corresponding condenser/evaporator, no phase separation and no other concentration-changing measure is performed. This embodiment of the process according to the invention can be employed in particular in installations with considerable preliminary liquefaction of air, i.e. with a high production of liquid and/or internal compression. In the case of an internal compression process, at least one of the products (for example nitrogen from the high-pressure column and/or medium-pressure column, oxygen from the medium-pressure column and/or low-pressure column) is removed in liquid form from one of the columns of the three-column system or from a condenser which is connected to one of these columns, is brought to an elevated pressure in the liquid state, is evaporated or (in the case of supercritical pressure) pseudo-evaporated in indirect heat exchange with the second charge air stream and is ultimately obtained as gaseous pressurized product. The air which is liquefied in the process or during a subsequent expansion step is then used as cooling fluid. The evaporated second charge air stream is preferably introduced into the low-pressure column. The liquefied air required (the second charge air stream) may also be produced in liquid installations without internal compression, for example in an air cycle.

Upstream of its use as cooling fluid, the second charge air stream can undergo work-performing expansion. For this purpose, it is introduced, in a liquid or supercritical state, into a liquid turbine, from which it emerges again in a completely or substantially completely liquid state.

As an alternative to a second charge air stream, a liquid from the high-pressure column, in particular a liquid from an intermediate point on the high-pressure column, can be used as cooling fluid for the condensation of the second nitrogen top gas from the medium-pressure column. As a result of the cooling fluid being removed from an intermediate point, its concentration can be selected specifically, and in this way the evaporation temperature during the indirect heat exchange with the condensing medium-pressure column nitrogen can be set optimally. This setting option is particularly advantageous since, in the process according to the invention, both the operating pressure of the medium-pressure column (by means of the heat exchange relationship with the crude argon column) and the pressure of the evaporating cooling fluid (at least atmospheric pressure or low-pressure column pressure) can be varied only within tight limits.

Above the feed for the first oxygen-enriched fraction, the medium-pressure column preferably has mass transfer elements covering at least seven theoretical plates. By way of example, the number of theoretical plates above the feed point is 7 to 50, preferably 16 to 22 theoretical plates.

Beneath the feed for the first oxygen-enriched fraction, the medium-pressure column does not have any mass transfer elements, or have mass transfer elements amounting to one to five theoretical plates, for example.

In many cases, it is expedient to feed a second charge fraction to the medium-pressure column. For this purpose, an additional fraction, which has a different composition from the first oxygen-enriched fraction, is extracted from the high-pressure column and fed to the medium-pressure column. If an intermediate liquid from the high-pressure column is used as cooling fluid, a part can be branched off and fed to the medium-pressure column as further charge fraction. In this case, the first charge fraction of the medium-pressure column (first oxygen-enriched fraction) is formed, for example, by bottom liquid from the high-pressure column.

The invention also relates to an apparatus for obtaining argon.

The invention and further details of the invention are explained in more detail below with reference to exemplary embodiments illustrated in the drawings.

DETAILED DESCRIPTION OF THE DRAWING

Figure 1:
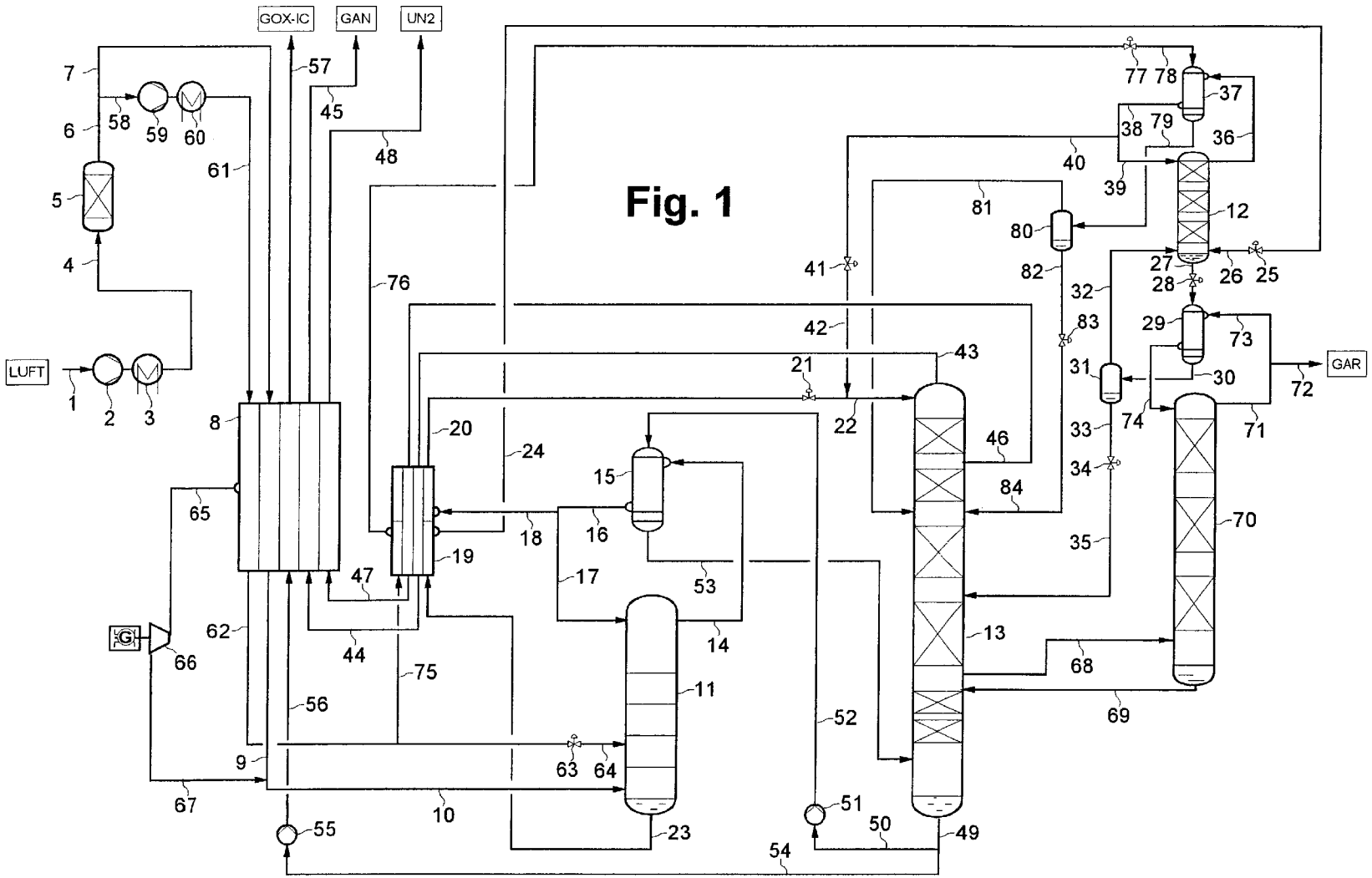
FIGS. 1–7 are schematic flowsheets of embodiments of the invention.

In the system illustrated in FIG. 1, atmospheric air 1 is compressed in an air compressor 2 with recooling 3. The compressed charge air 4 is fed to a cleaning device 5 which is formed, for example, by a pair of molecular sieve adsorbers. A first part 7 of the cleaned air 6 is cooled to approximately its dewpoint in a heat exchanger 8. The cooled first part 9 of the air is mixed with another gaseous air stream 67. In the exemplary embodiment, the mixture forms the "first charge air stream", which is fed via line 10, without restriction, to the high-pressure column 11 of a three-column system. The three-column system also has a medium-pressure column 12 and a low-pressure column 13.

In the example, the entire top product of the high-pressure column 11 ("first nitrogen top gas") is passed via line 14 into a main condenser 15, where it is completely or substantially completely condensed. A first part 17 of liquid nitrogen 16 which is formed in the process is passed to the high-pressure column 11 as reflux. A second part 18 is cooled in a supercooling countercurrent heat exchanger 19 and is passed via line 20, restrictor valve 21 and line 22 to the top of the low-pressure column 13.

A first oxygen-enriched liquid, which is fed as "first oxygen-enriched fraction" into the medium-pressure column 12 via line 23, supercooling countercurrent heat exchanger 19, line 24, restrictor valve 25 and line 26, is produced in the bottom of the high-pressure column 11. In the example, the medium-pressure column 12 does not have any mass transfer elements below the feed for the first oxygen-enriched fraction 26; the mass transfer elements above the feed are formed by ordered packing which corresponds to a total of 22 theoretical plates.

The bottom product of the medium-pressure column ("second oxygen-enriched liquid") is passed via line 27 and control valve 28 into the evaporation space of a crude argon condenser 29, where it is partially evaporated. The two-phase mixture 30 formed in the process is introduced into a separator (phase separator) 31. The proportion 32 which is in vapour form flows back as "oxygen-enriched vapour" into the medium-pressure column 12, where it is used as rising vapour. The remaining liquid 33 is throttled (34) and fed to the low-pressure column 13 as oxygen-enriched charge 35.

The second nitrogen top gas, which forms at the top of the medium-pressure column 12, is in this example completely removed via line 36 and completely condensed in the liquefaction space of a medium-pressure column top condenser 37. A first part 39 of liquid nitrogen 38 which is formed in the process is added to the medium-pressure column 12 as reflux. A second part 40 is passed via restrictor valve 41 and lines 42–22 to the top of the low-pressure column 13 and/or is obtained directly at liquid product (not shown).

Gaseous nitrogen 43–44–45 and impure nitrogen 46–47–48 are removed from the upper region of the low-pressure column 13, heated in the supercooling countercurrent heat exchanger 19 and in the main heat exchanger 8 and extracted as product (GAN) or remainder gas (UN2).

A first part 50–52 of liquid nitrogen 49 from the bottom of the low-pressure column 13 is conveyed by means of a pump 51 into the evaporation space of the main condenser 15, where it is partially evaporated. The two-phase mixture formed in the process is returned to the bottom of the low-pressure column 13. The remainder 54 of the low-pressure column bottom liquid 49 is brought to the desired product pressure in an internal compression pump 55, is fed to the main heat exchanger 8 via line 56, is evaporated or pseudo-evaporated and heated in the main heat exchanger 8 and is finally removed via line 57 as gaseous pressurized product (GOX-IC). Any desired product pressure can be achieved by means of the internal compression. This pressure, may, for example, be between 3 and 120 bar.

The heat which is required for the (pseudo) evaporation of the internally compressed oxygen 56 is provided by a second part 62 of the charge air, which is branched off from the purified charge air 6 via line 58, is brought to the high pressure required for this purpose in a recompressor 59 with recooler 60, and is fed via line 61 to the main heat exchanger 8. The second part 62 of the charge air is introduced at least in part as "second charge air stream", via line 75, supercooling countercurrent heat exchange 19, line 76, restrictor valve 77 and line 78, into the evaporation space of the top condenser 37 of the medium-pressure column, without previously having been subjected to phase separation or any other concentration-changing measure. It is partially evaporated in the medium-pressure column condenser 37. The two-phase mixture 79 which is formed in the process is introduced into a separator (phase separator) 80. The proportion 81 which is in vapour form flows into the low-pressure column 13. The remaining liquid 82 is likewise fed (84), via a valve 83, to the low-pressure column 13. The feed point lies below the impure nitrogen cap 46 and above the feed 35 for the medium-pressure column bottom liquid.

The remainder of the cryogenic high-pressure air 62 is throttled (63) to high-pressure column pressure and is introduced into the high-pressure column 11 via line 64. The feed point preferably lies a few theoretical plates above the bottom, at which the gaseous air 10 is introduced.

A part 65 of the purified charge air 6 is recompressed together with the second part 62 and is introduced (58–59–60–61) into the main heat exchanger 8, but is then removed again at an intermediate temperature and fed to an expansion machine 66, which in this example is in the form of a generator turbine. The third part 67 of the charge air, which has undergone work-performing expansion, is passed to the high-pressure column 11 together with the first part 9 as "first charge air stream" 10.

The low-pressure column 13 is in communication with a crude argon column 70 via a gasline 68 and a liquid line 69. An argon-containing fraction in gas form is introduced into the crude argon column via 68, where it is separated into a crude argon top fraction and an oxygen-rich liquid in the bottom. In the present example, a first part 72 of the gaseous crude argon top fraction 71 is obtained as crude argon product (GAR). If appropriate, it can be purified further, for example in a pure argon column (not shown). The remainder 73 is completely or substantially completely liquefied in the crude argon condenser 29 and is added to the top of the crude argon column 70 as reflux via line 74.

In the present example, all three condenser/evaporators 15, 29, 37 are designed as falling-film evaporators. However, within the context of the invention each may also be produced by a different type of evaporator, for example a forced circulation evaporator (thermosiphon evaporator). If, for example, the crude argon condenser is designed as a forced circulation evaporator, it may be arranged directly in the bottom of the medium-pressure column 12. Therefore, in terms of apparatus, the crude argon column 70 and medium-pressure column 12 could also be arranged in the form of a double column and accommodated, for example, in a common vessel.

However, within the context of the invention it is generally more advantageous for a falling-film evaporator to be used at this very point and for its low temperature difference to be utilized in order to optimize the column pressures. If low-pressure column 13, medium-pressure column 12, crude argon condenser 29 and crude argon column 70 are arranged above one another, as illustrated in the drawing, it is even possible to dispense with the circulation pump (cf. pump 51 for the main condenser 15) which is otherwise required for falling-film evaporators. Purely on account of the static pressure, the liquid flows via the lines 27, 30, 33, 35 out of the medium-pressure column 12, via crude argon condenser 29, into the low-pressure column 13. There is also no need for a pump on the liquefaction side.

The operating pressures of the columns (in each case at the top) are:

| | |
|---|---|
| high-pressure column 11 | for example 4 to 12 bar, preferably approximately 6 bar |
| medium-pressure column 12 | for example 1.2 to 2 bar, preferably approximately 1.4 bar |
| low-pressure column 13 | for example 1.2 to 2 bar, preferably approximately 1.6 bar |

Figure 2:
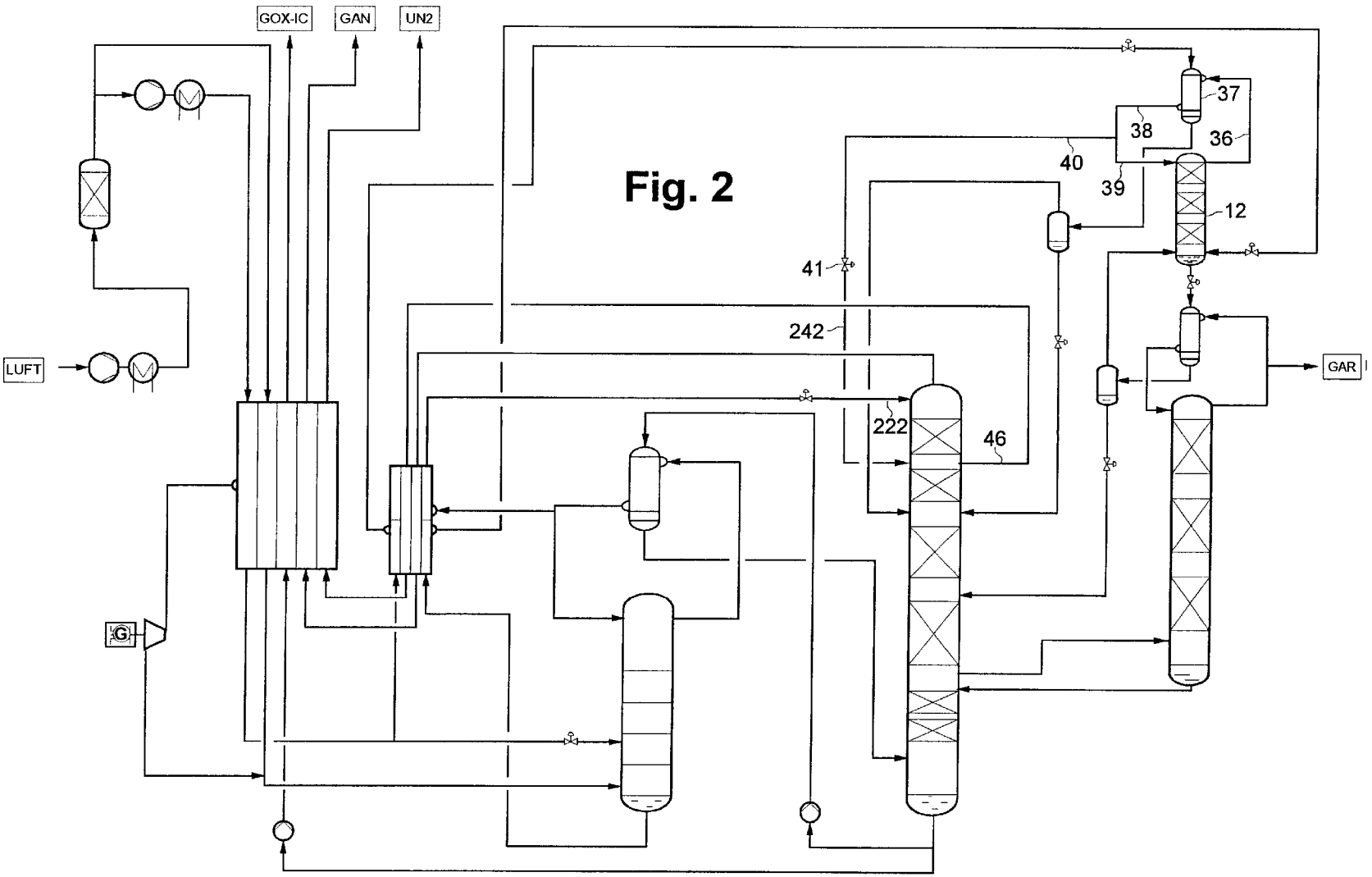

In the process shown in FIG. 2, the medium-pressure column 12 has fewer theoretical plates, for example 12. The top product 37 and the liquid 38, 39, 40 formed in the top condenser 37 of the medium-pressure column therefore have a lower purity than the nitrogen from the high-pressure column or the main condenser, which is added at the top of the low-pressure column via line 222. The liquid medium-pressure column nitrogen 242, which has been restricted at 41, is therefore introduced into the low-pressure column at an intermediate point, in the example illustrated approximately at the level at which the impure nitrogen is removed.

Figure 3:
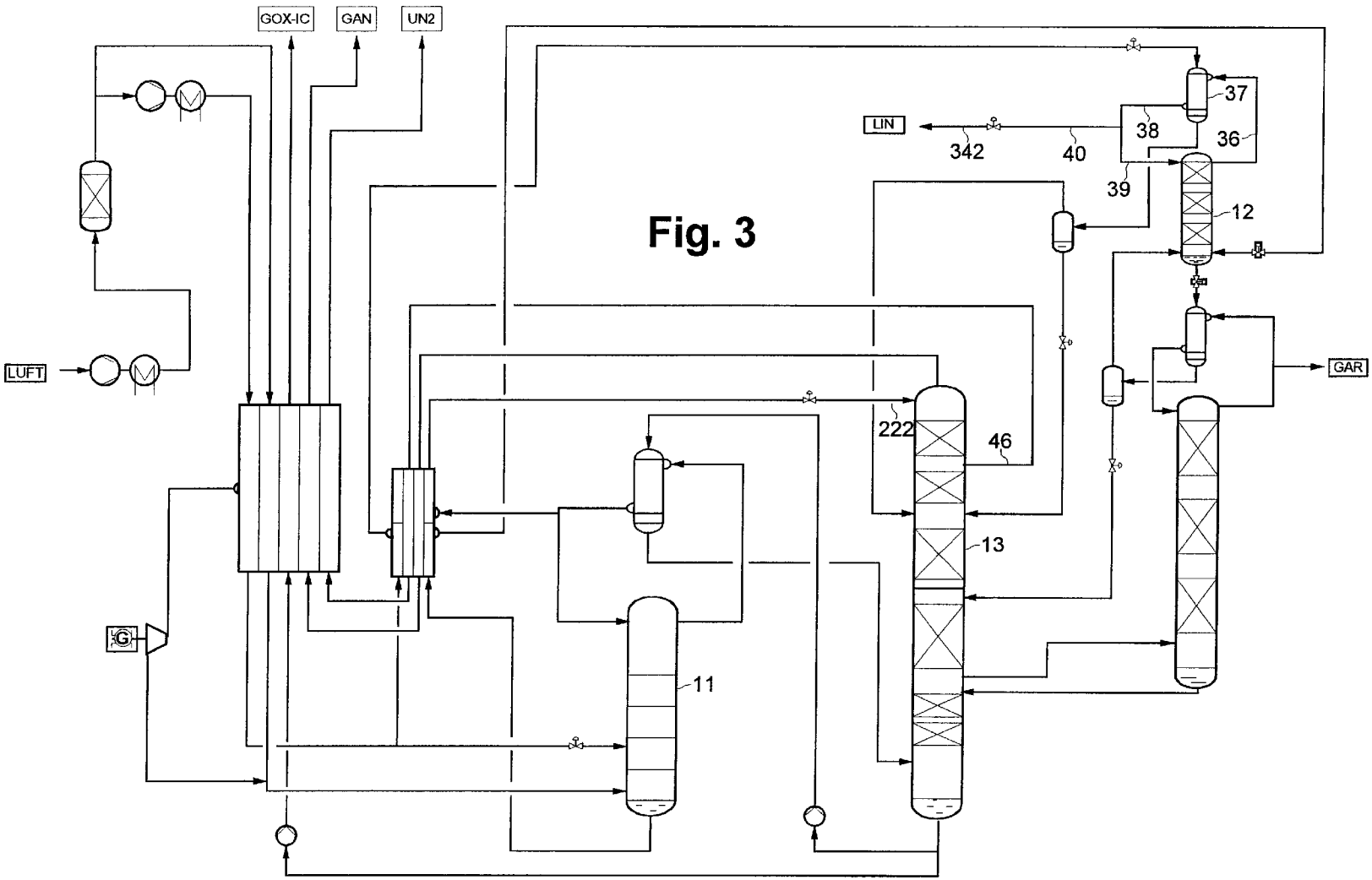

In FIG. 3, all the medium-pressure column nitrogen 40 which is not used as reflux 39 in the medium-pressure column 12 is extracted as liquid product (LIN) via line 342. The number of plates in the medium-pressure column 12 can therefore be adapted to product requirements. Since there is no medium-pressure column nitrogen introduced into the low-pressure column, the product purity in the medium pressure column can be set independently of the concentrations of the top fractions in high-pressure column 11 and low-pressure column 13. Conversely, the products of the low-pressure column are not affected by any fluctuations in operation of the medium-pressure column.

Figure 4:
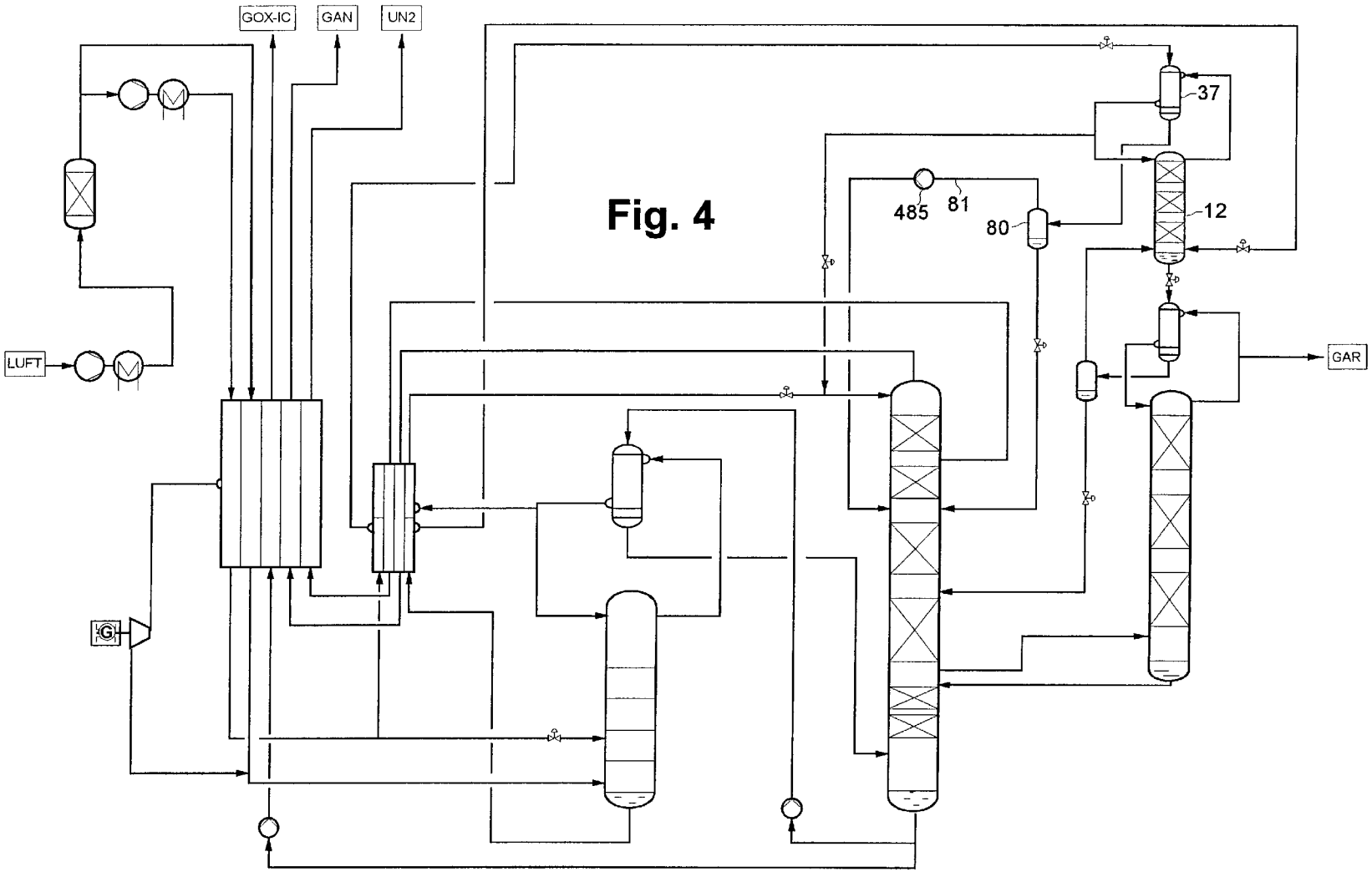

On account of the temperature and pressure differences and the concentrations, the pressure on the evaporation side of the top condenser 37 of the medium-pressure column 12 may be lower than the operating pressure of the low-pressure column 13. In this case, the condenser configuration shown in FIG. 2 can nevertheless be used if the vapour 81 from the separator 80 is forced into the low-pressure column by means of a cold fan 485, as illustrated in FIG. 4.

Figure 5:
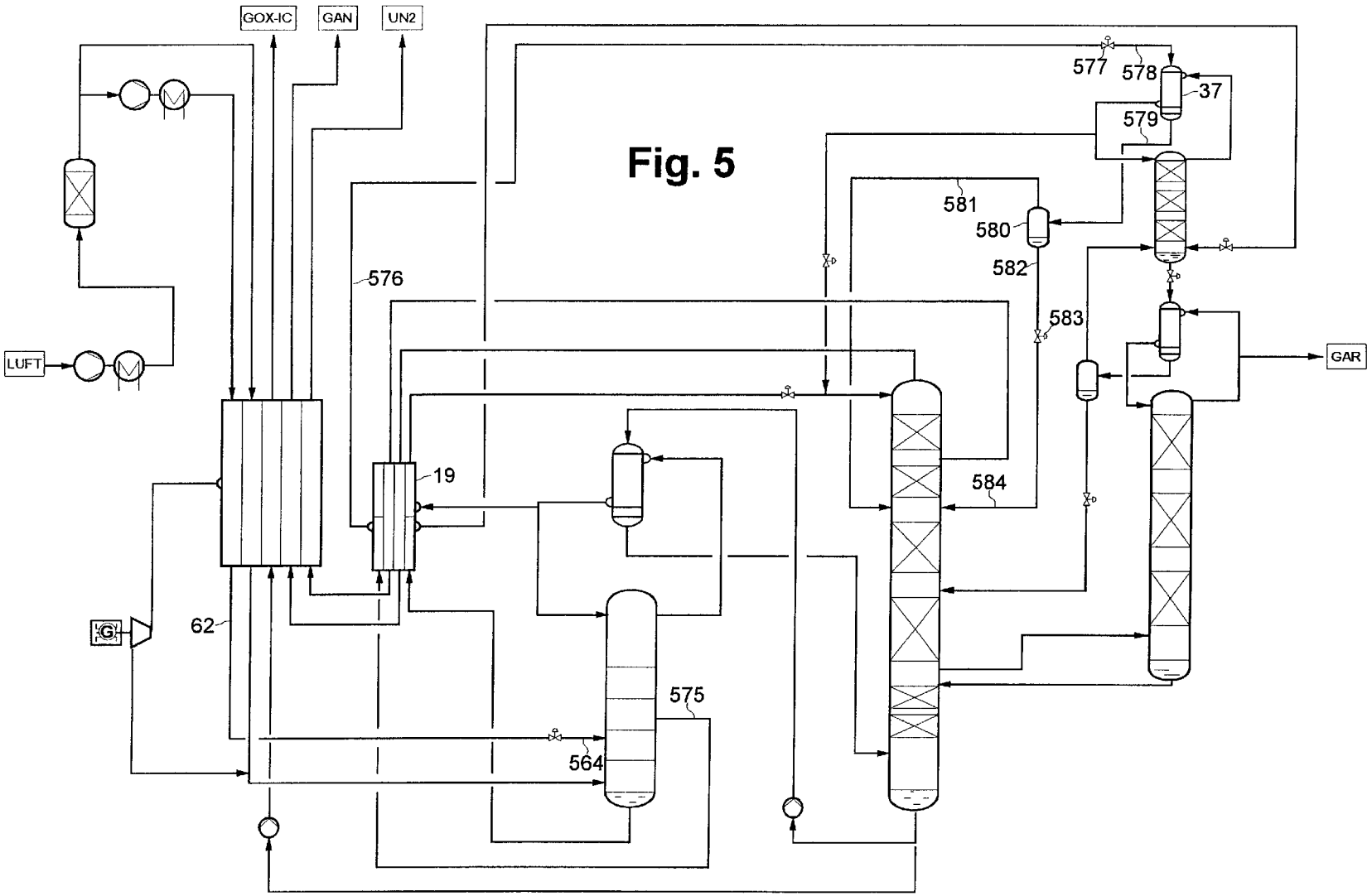

The exemplary embodiment illustrated in FIG. 5 represents another modification to the process shown in FIG. 1. In this case, all the cryogenic high-pressure air is introduced into the high-pressure column via line 564. The cooling fluid for the top condenser 37 of the medium-pressure column is formed by an intermediate liquid 575 of the high-pressure column, which is supplied via the supercooling countercurrent heat exchanger 19, line 576, restrictor valve 577 and line 578. The guidance of the flow downstream of the evaporator space of the top condenser 37 (579 to 584) is the same as that shown in FIG. 1. In this example, the intermediate liquid 575 is taken off slightly above the feed for the liquefied air 564. There are preferably approximately 2 to 10 theoretical plates between the two tapping points. Alternatively, it may also be removed at the level of the liquefied-air feed or slightly below it.

Figure 6:
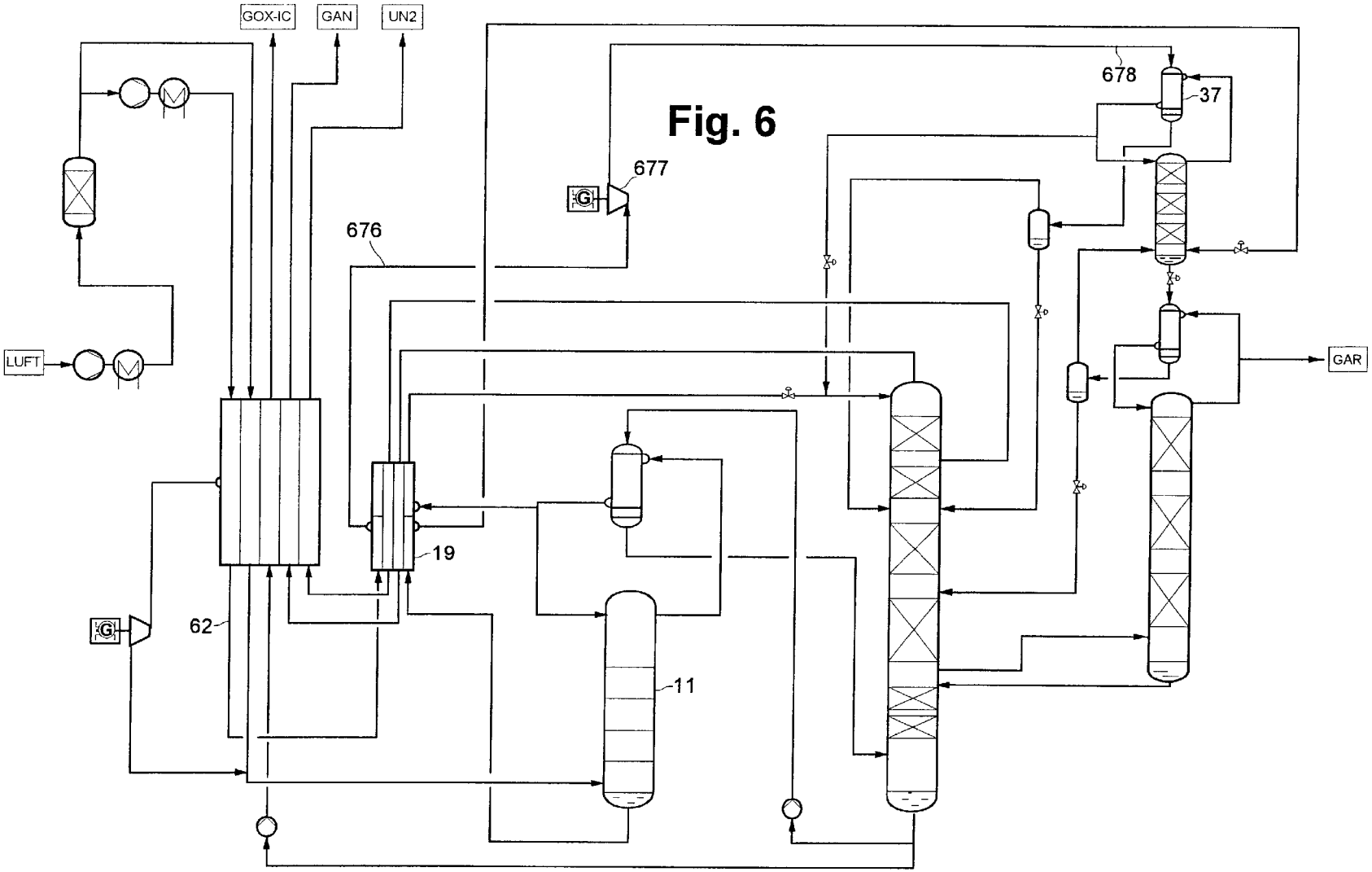

In FIG. 6, the second charge air stream 676, before being introduced 678 into the evaporation space of the top condenser 37 of the medium-pressure column, is expanded not via a restrictor valve (77 in FIG. 1), but rather in a liquid turbine 677. The work performed in the process is converted into electrical energy, in the example illustrated by means of a generator. In the exemplary embodiment shown in FIG. 6, all the cryogenic high-pressure air 62 is passed into the liquid turbine 677 and on to the top condenser 37. No liquefied air flows into the high-pressure column 11.

Figure 7:
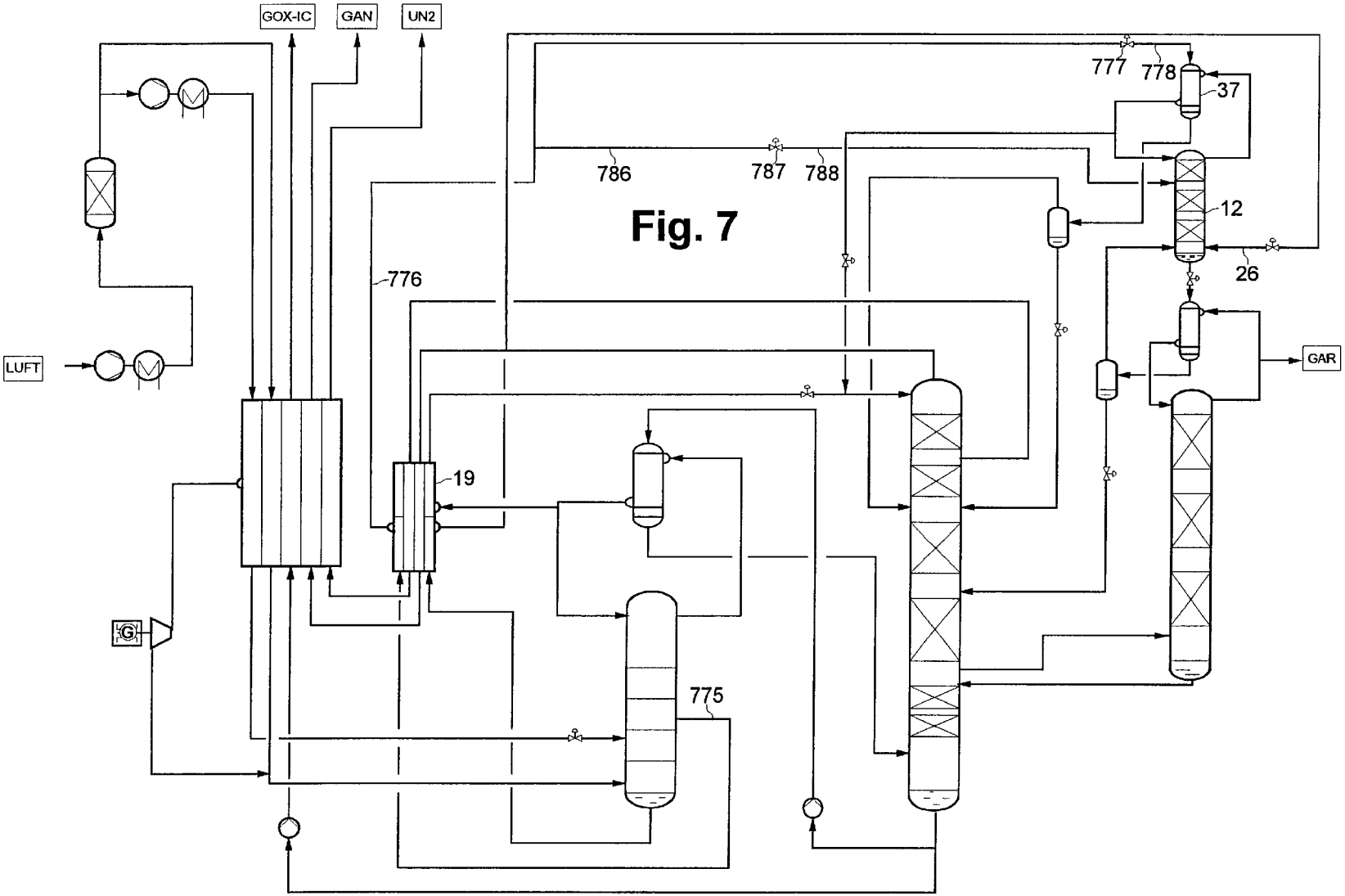

Unlike in FIG. 5, in the process illustrated in FIG. 7, not all of the intermediate liquid 775, 776 from the high-pressure column is passed via 777–778 into the evaporation space of the top condenser 37 of the medium-pressure column. Rather, a part 786–787–788 flows as "additional fraction" into the interior of the medium-pressure column 12. The feed point for the further charge fraction 788 lies above the feed 26 for the high-pressure column bottom liquid. Alternatively, it is possible for all the intermediate liquid 775, 776 to be introduced (788) into the medium-pressure column 12. The cooling fluid for the medium-pressure column top condenser 37 is then formed by a different fluid, for example by liquefied charge air (cf. for example FIG. 1), by high-pressure column bottom liquid, by liquid from a different intermediate point of the high-pressure column or by an oxygen-enriched liquid from a medium-pressure column or low-pressure column.

As will be immediately apparent to the person skilled in the art, further combinations of the individual features outlined in the exemplary embodiments are possible within the context of the invention.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding German application 10113791.5, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. Process for obtaining argon using a three-column system for the fractionation of air, which has a high-pressure column (11), a low-pressure column (13) and a medium-pressure column (12), in which process (a) a first charge air stream (10, 64, 564) is introduced into the high-pressure column (11), where it is separated into a first oxygen-enriched liquid and a first nitrogen top gas, (b) a first oxygen-enriched fraction (23, 24, 26) from the high-pressure column (11) is introduced into the medium-pressure column (12) where it is separated into a second oxygen-enriched liquid and a second nitrogen top gas, (c) at least a part (36) of the second nitrogen top gas from the medium-pressure column (12) is at least partially condensed by indirect heat exchange (37) with a cooling fluid (78, 678, 778), (d) a second oxygen-enriched fraction (33, 35) from the high-pressure column and/or from the medium-pressure column (12) is introduced into the low-pressure column (13), where it is separated into a third oxygen-enriched liquid and a third nitrogen top gas, (e) an argon-containing fraction (68) from the three-column system is introduced into a crude argon column (70), where it is separated into a crude argon top fraction and an oxygen-rich liquid, (f) at least a part (73) of the crude argon top fraction (71) is passed into a crude argon condenser (29), where it is at least partially condensed by indirect heat exchange with at least a part (27) of the second oxygen-enriched liquid from the medium-pressure column (12), (g) the second oxygen-enriched liquid being at least partially evaporated during the indirect heat exchange in the crude argon condenser (29), and oxygen-enriched vapour (32) which is formed during the evaporation being returned to the medium-pressure column (12), and in which process (h) a fraction (72) from the upper region of the crude argon column (70) and/or a part of the crude argon top fraction downstream of the crude argon condenser is obtained as crude argon product.

2. Process according to claim 1, in which the crude argon condenser is designed as a falling-film evaporator, the second oxygen-enriched liquid from the medium-pressure column (12) being only partially evaporated in the crude argon condenser, and the resulting two-phase mixture (30) being introduced into a phase-separation device (31), in which the oxygen-enriched vapour (32) and a proportion (33) which has remained in liquid form are separated from one another, the proportion (33) which has remained in liquid form being introduced (34, 35) into the low-pressure column (13).

3. A process according to claim 1, further comprising liquefying a second air stream charge (62, 75, 76, 676) and employing the resultant liquefied second air stream charge as cooling fluid (78) for the condensation of the second nitrogen top gas (36) from the medium-pressure column (12).

4. A process according to claim 3, further comprising subjecting the second air stream charge (676) to work-performing expansion (677) upstream of its use as cooling fluid (678).

5. A process according to claim 1, comprising withdrawing a liquid from the high-pressure column (11) and employing the withdrawn liquid as cooling fluid (578, 778) for the condensation of the second nitrogen top gas (36) from the medium-pressure column (12).

6. A process according to claim 1, in which the medium-pressure column (12) has mass transfer elements amounting to at least seven theoretical plates above the feed for the first oxygen-enriched fraction (26).

7. A process according to claim 1, in which the medium-pressure column (12) does not have any mass transfer elements, or has mass transfer elements amounting to from one to five theoretical plates, below the feed for the first oxygen-enriched fraction (26).

8. A process according to claim 1, further comprising extracting from the high-pressure column (12) an additional fraction (786, 788), which has a different composition from the first oxygen-enriched fraction (26), (775, 776) and feeding said additional fraction to the medium-pressure column (12).

9. Apparatus for obtaining argon, having a three-column system for the fractionation of air, which has a high-pressure column (11), a low-pressure column (13) and a medium-pressure column (12), having (a) a first charge air line (10, 64, 564) for introducing a first charge air stream into the high-pressure column (11), (b) a first crude oxygen line (23, 24, 26) for introducing a first oxygen-enriched fraction from the high-pressure column (11) into the medium-pressure column (12), (c) a second crude oxygen line (33, 35) for introducing a second oxygen-enriched fraction from the high-pressure column and/or from the medium-pressure column (12) into the low-pressure column (13), (d) an argon transfer line (68) for introducing an argon-containing fraction (68) from the three-column system into a crude argon column (70), (e) a crude argon condenser (29) for the at least partial condensation of at least a part (73) of a crude argon top fraction (71) from the crude argon column (70) by indirect heat exchange with an oxygen-enriched liquid (27) from the medium-pressure column (12), (f) a vapour return line (32) for returning oxygen-enriched vapour (32) from the crude argon condenser (29) to the medium-pressure column (12), and having (g) a crude argon product line (73) which is connected to the upper region of the crude argon column (70) and/or the crude argon condenser (29).

10. Apparatus according to claim 9, in which the crude argon condenser (29) is designed as a falling-film evaporator.

11. Apparatus according to claim 9, further comprising a medium-pressure column condenser (37), the liquid fraction space of which is connected (36) to the upper region of the medium-pressure column (12) and the evaporation space of which is connected to a feed line (78, 678, 778) for a cooling fluid.

12. Apparatus according to claim 11 in which the feed line (678) leads through a liquid turbine (677).

13. Apparatus according to claim 9, in which the medium-pressure column (12) has mass transfer elements amounting to at least seven theoretical plates above the feed for the first oxygen-enriched fraction (26), and/or in that the medium-pressure column (12) does not have any mass transfer elements or has mass transfer elements amounting to from one to five theoretical plates below the feed for the first oxygen-enriched fraction (26).

14. Apparatus according to claim 11, said feed line being connected (575, 576, 775, 776) to a second charge air line (62, 75, 76, 676) and/or to the high-pressure column (11).

15. A process according to claim 5, wherein the liquid withdrawn from the high pressure column is withdrawn from an intermediate point (575, 576, 775, 776) from the high pressure column.

* * * * *